United States Patent [19]

Radowicz

[11] 4,220,114

[45] Sep. 2, 1980

[54] APPLICATOR HEAD FOR ADHESIVE APPLICATION SYSTEM

[76] Inventor: Richard D. Radowicz, 25860 Rancho Alto Dr., Carmel, Calif. 93923

[21] Appl. No.: 944,762

[22] Filed: Sep. 22, 1978

[51] Int. Cl.[2] ..... B05C 5/02; B05C 7/00

[52] U.S. Cl. ..... 118/411; 156/578

[58] Field of Search ..... 118/411, 410, 412, 408; 156/578; 425/380, 382 R

[56] References Cited

U.S. PATENT DOCUMENTS

| | | | |
|---|---|---|---|
| 3,938,467 | 2/1976 | Radowicz | 118/411 |
| 4,015,926 | 4/1977 | Nehmey | 425/382 R X |
| 4,038,442 | 7/1977 | Utumi | 118/411 X |

*Primary Examiner*—John P. McIntosh

*Attorney, Agent, or Firm*—Flehr, Hohbach, Test

[57] ABSTRACT

A dispensing head for applying adhesive to a contoured surface of one object which is to be bonded to a complimentary surface of another object is disclosed herein. This dispensing head includes two sections, one of which is provided for receiving adhesive from a supply thereof. The other section is provided for applying this adhesive to the contoured surface to be bonded and includes a complementary adhesive applying surface and a network of channels extending between the adhesive receiving section and the adhesive applying surface. While each of these channels is closed along its length during operation of the dispensing head, the section of the dispensing head defining these channels is divided into two disengagably connected subsections for providing ready access into and along the length of each channel.

3 Claims, 10 Drawing Figures

APPLICATOR HEAD FOR ADHESIVE APPLICATION SYSTEM

BACKGROUND OF THE INVENTION

The present invention relates generally to systems including a dispensing head for applying adhesive to the contoured surface of a given object, for example the end of a jointed beam, as described in U.S. Pat. No. 3,938,467 (Radowicz) entitled END JOINTED BEAM AND LAMINATED BEAM ADHESIVE APPLICATION SYSTEM AND HEAD FOR USE THEREIN, and more particularly to an improved dispensing head comprising part of the overall system.

As the title infers, the Radowicz patent just recited is directed to a system and application head for depositing adhesive on surfaces to be bonded, specifically to complimentary surfaces of an end jointed beam. The particular application head or adhesive dispensing head as it is also called includes first and second body members. The first body member is adapted for connection to a supply of adhesive and includes an internal plenum chamber for receiving the adhesive from this supply. The second body member has an adhesive applying surface which is complementary to the contoured surface to be bonded and a plurality of channels extending between the plenum chamber within the first body member and its adhesive applying surface for dispensing adhesive to the latter.

In the particular embodiment illustrated in the Radowicz patent, the second body member, that is, the body member including the plurality of adhesive dispensing channels, is a unitary member and the various channels are drilled or similarly provided therein. This particular dispensing head functions in a satisfactory manner for applying adhesive substance to the contoured surface to be bonded from an appropriate supply as described in the patent. However, there are two specific improvements in the dispensing head of the present invention as compared to the dispensing head described in the Radowicz patent. The first area of improvement relates to the way in which the channel defining body member of the dispensing head disclosed in the Radowicz patent is actually constructed and the second area relates to the way in which the channels are cleaned or otherwise maintained free of solid adhesive or foreign particles. More specifically, in the Radowicz patent the various channels or holes must be carefully drilled or similarly provided in the unitary body of the dispensing head which is time consuming and therefore relatively expensive. In addition, access into these channels for removing solid adhesive or foreign matter is also time consuming, requiring a very thin brush or other such means to be inserted into each and every channel. As will be seen hereinafter, the dispensing head constructed in accordance with the present invention eliminates both of these relatively time consuming operations.

Objects and Summary of the Invention

One object of the present invention is to provide an adhesive applying dispensing head which is especially suitable for use in an overall system of the general type described in U.S. Pat. No. 3,938,467 which was discussed briefly above and which is incorporated herein by reference.

Another object of the present invention is to provide an uncomplicated and yet reliable and economical way of rapidly providing internal channels in this adhesive dispensing head.

Still another object of the present invention is to provide a dispensing head including internal channels which can be rapidly and reliably cleaned in an economical manner.

As stated previously, the dispensing head constructed in accordance with the present invention is provided for applying adhesive to a contoured surface of one object which is to be bonded to the complimentary surface of another object. As will be discussed in more detail hereinafter, this dispensing head includes two body members or two sections of a single body member, one of which is connected to a supply of adhesive and which includes means for receiving adhesive from this supply. The other body member or section includes an adhesive applying surface substantially complementary to the contoured surface of the object to be bonded and a network of channels extending between the adhesive receiving means of the first body member and this adhesive applying surface.

The dispensing head thus far described may be similar to the dispensing head described in the Radowicz patent as discussed above. However, in the dispensing head constructed in accordance with the present invention, the second mentioned body member or section includes two subsections which together define all of the adhesive dispensing channels along internal confronting surfaces which when held together close each channel along its length. On the other hand, when these subsections are separated from one another, each of the internal channels is opened along its length for access therein. In this way, the channels can be easily, reliably and economically machined into one or both of the confronting surfaces of the two subsections before the two are connected together and they can be rapidly, reliably and economically cleaned periodically, merely by separating the two subsections from one another.

DETAILED DESCRIPTION AND PREFERRED EMBODIMENTS

Figure 1:
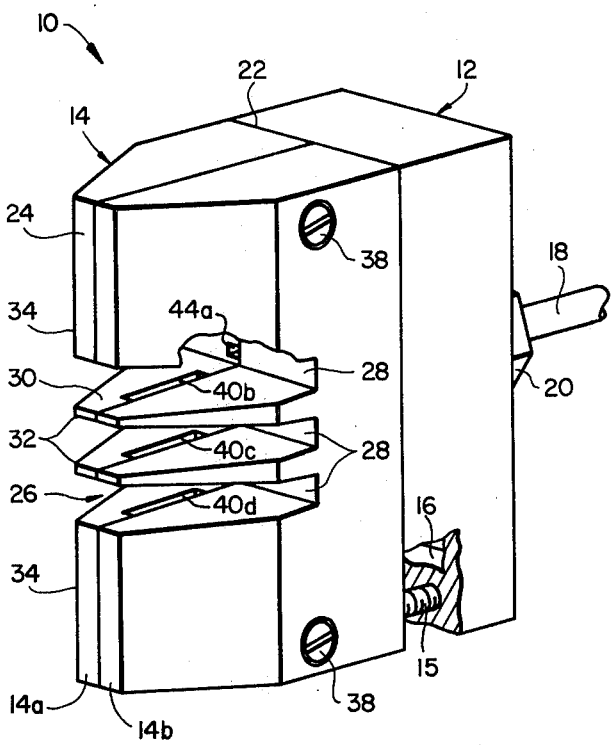
FIG. 1 is a perspective view of an adhesive dispensing head which is constructed in accordance with the present invention and which is especially suitable for use in the system described in the above recited United States patent.

Turning to the drawings, wherein like components are designated by like reference numerals throughout the various figures, attention is specifically directed to FIG. 1 which illustrates a dispensing head constructed in accordance with the present invention and generally designated by the reference numeral 10. This dispensing head includes an adhesive receiving section or body member 12 and an adhesive dispensing section or body member 14 which are disengagably connected together by bolts 15 or other suitable means. Adhesive receiving section 12 which is adapted for connection to a supply of adhesive (not shown) may be identical to the corresponding section described in the above recited Radowicz patent and, hence, includes an internal plenum chamber 16. This plenum chamber is connected in fluid communication with the adhesive supply (not shown) by means of line 18 and fixture 20.

Section 14 of dispensing head 10 includes a back end 22 which bears against the front end of section 12 when the two sections are connected together and a front end 24. As illustrated in FIG. 1, front end 24 includes an adhesive applying surface which is generally designated at 26 and which is substantially complimentary to the contoured surface to be bonded, for example the jointed end of a beam. In the actual embodiment illustrated, this overall adhesive applying surface is made up of a first group of spaced-apart planar surfaces 28 which substantially lie in a common plane and a second group of spaced-apart planar surfaces 30 which project out from surfaces 28 and which intersect these latter surfaces along parallel lines of intersection. In the embodiment illustrated, the overall adhesive applying surface 26 comprises part of an overall surface defined by a pair of intermediate finger like members 32 and outwardly projecting end members 34. However, it is to be understood that the dispensing head is not limited to this particular configuration but rather to any configuration which is compatible with the present invention.

Figure 5:
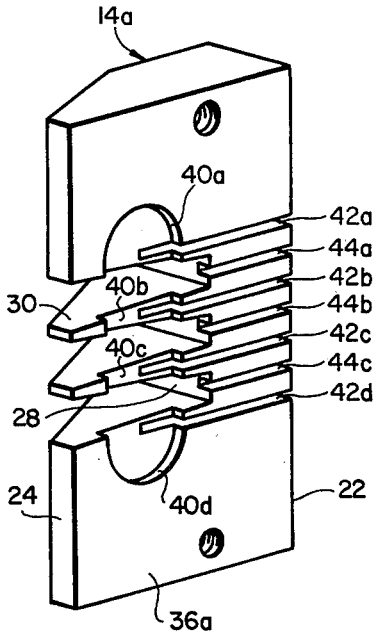
FIG. 5 is a perspective view of the component illustrated in FIG. 2.
Figures 6, 8:
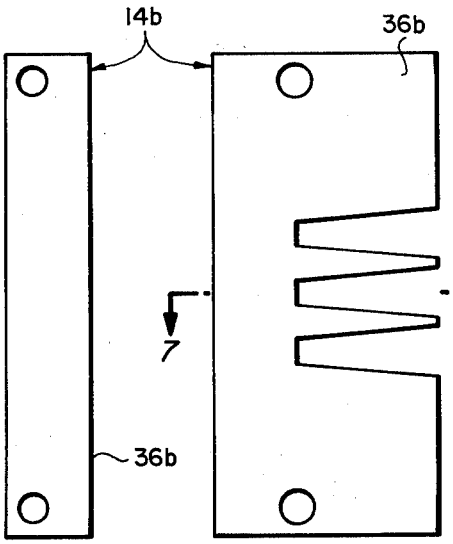
FIG. 6 is a side elevational view of a second component which comprises part of the dispensing head illustrated in FIG. 1 and which is adapted for complementary engagement with the component illustrated in FIGS. 2 to 5.
FIG. 8 is a back view of the component illustrated in FIG. 6.
Figures 2, 3:
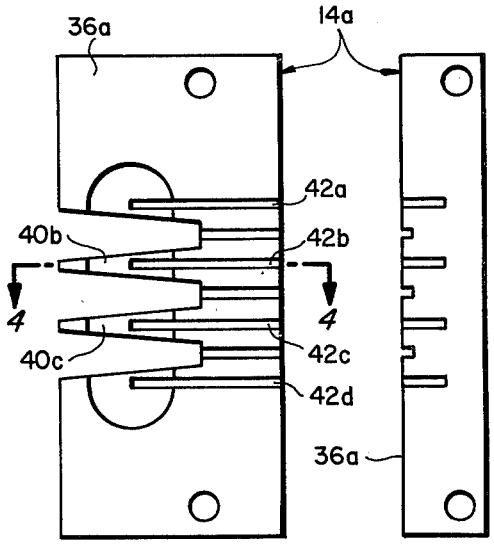
FIG. 2 is a side elevational view of one component comprising part of the head illustrated in FIG. 1.
FIG. 3 is a back elevational view of the component illustrated in FIG. 2.

In accordance with the present invention, adhesive dispensing section 14 of dispensing head 10 is divided into two separate subsections **14*a* and 14*b* having respective complementary surfaces 36*a* (FIGS. 2 and 5) and 36*b* (FIG. 6). These confronting surfaces preferably extend from the front end 24 of section 14 to its back end 22 normal to planar surfaces 28 and 30 and the parallel lines of intersection defined thereby as seen in FIGS. 2, 5 and 6. As will be seen hereinafter, these two subsections together define a network of internal channels extending between adhesive receiving plenum chamber 16 of section 12 and planar surfaces 28 and 30 for dispensing adhesive from the plenum chamber to the planar surfaces. While each of these channels is closed along its entire length when the two subsections 14*a* and 14*b* are held together in the manner illustrated in FIG. 1, when these subsections are separated each channel is opened along its length so that it can be easily provide initially as well as readily cleaned after subsequent operation of the dispensing head. In this regard, the two subsections are disengagably connected by suitable means such as bolts 38** or the like.

Figure 4:
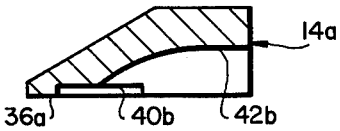
FIG. 4 is a sectional view of the component illustrated in FIG. 2, taken generally along line 4—4 in FIG. 2.

Turning to FIGS. 2 to 5, attention is specifically directed to subsection **14*a*. As illustrated in these figures, all of the channels making up the network recited above are provided in subsection 14*a* and extend therein from confronting surface 36*a* where they are opened along their entire length. These channels may be divided into three groups, a first group including channels 40*a*, *b*, *c* and *d*, a second group including channels 42*a*, *b*, *c* and *d* and a third group including channels 44*a*, *b* and *c*. As seen best in FIG. 5, channels 40*a* to 40*d* which are substantially wider than the other channels are colinear with each other and extend in a direction substantially parallel with previously described planar surfaces 28. Channels 40*a* and 40*d* extend inwardly from these planar surfaces 30 comprising part of projecting end member 34 and each of the channels 40*b* and 40*c* extends extirely across its associated finger like member 32 from one planar surface 30 of that finger like member to its opposite planar surface. Moreover, as illustrated best in FIG. 2, each of these channels are spaced inwardly from front end 24. In this regard, it is to be understood that these channels could extend all the way to front end 24 so that the ultimately provided slots formed thereby, as shown in FIG. 1, would extend all the way to end 24 rather than stopping short thereof, as shown. The channels 42*a* through 42*d* extend from the back end 22 of section 14 to approximately the centers of transverse channels 40*a* through 40*d* in a direction normal to channels 40*a* to 40*d* and planar surfaces 28. In this regard, as best seen in FIG. 4 in conjunction with FIGS. 2 and 5, the channels 42 are substantially deeper than the channels 40 and curve into these latter channels as indicated by channel 42*b* in FIG. 4. Channels 44*a* to 44*c* extend in directions parallel to the channels 42 between back end 42 and planar surfaces 28. While channels 44 are of approximately the same width as channels 42 and hence substantially narrower than channels 40, they are not nearly as deep as channels 42, as illustrated in FIG. 3**.

Figure 7:
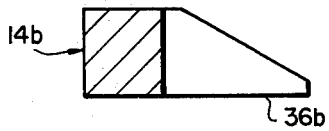
FIG. 7 is a sectional view of the component illustrated in FIG. 6 taken generally along line 7—7 in FIG. 6.

Having described subsection **14*a* of adhesive dispensing section 14, attention is now directed to subsection 16*b* which is illustrated in FIGS. 6 to 8. As seen in these figures, particularly FIG. 6, subsection 14*b* does not include any of the channels making up the overall network described previously. Rather, confronting surface 36*b* is substantially planar. This surface serves to close each channel 40, 42 and 44 along its length when the two subsections are connected together with surfaces 36*a* and 36*b* engaging one another. However, by merely separating subsection 36*b* from subsection 36*a*, the various channels can be easily cleaned of solid adhesive or foreign matter. Moreover, these channels can be rapidly and accurately machined, molded or otherwise initially provided into surface 36*a*** before the two sections are even connected together.

Having described both subsection **14*a* and 14*b* making up part of overall dispensing head 10, its manner of operation should be quite apparent, especially in view of the Radowicz patent recited above. In this regard, attention is redirected to FIG. 5. In this figure, it can be seen that the adhesive is dispensed to planar surfaces 28 directly by means of channels 44. On the other hand, adhesive dispensed to surfaces 30 first passes through channels 42 and thereafter fills channels 40. Channels 40*a* and 40*b* serve to dispense adhesive to the two outermost projecting planar surfaces while each of the channels 40*b* and 40*c* serve to dispense adhesive to two planar surfaces, as clearly indicated in FIG. 5. In this regard, while the preferred embodiment of the present invention includes all of the channels in one subsection as illustrated herein, it is to be understood that some of these channels could be provided in the other subsection making up section 14. Moreover, the present invention is not limited to the particular configuration of the channel network illustrated but may vary depending upon the particular configuration of the overall adhesive dispensing section and its adhesive applying surface. Moreover, section 12 of the dispensing head could be divided into two disengagably connected subsections and each of these subsections could comprise an integral part of a corresponding subsection 14***a* and 14*b*.

Figure 9:
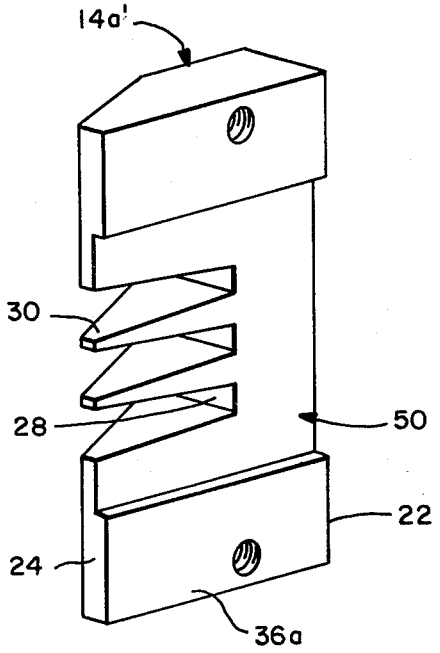
FIG. 9 is a perspective view of a modified component of the dispensing head.
Figure 10:
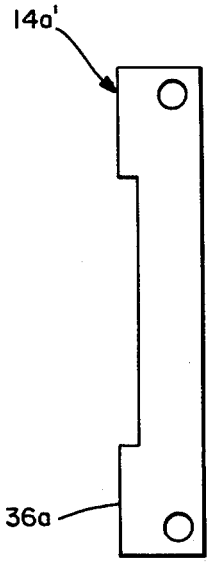
FIG. 10 is a back elevational view of the component illustrated in FIG. 9.

Turning now to FIGS. 9 and 10, a modified subsection 14*a*′ (corresponding to previously described subsection 14*a*) is illustrated. This modified sub-section is identical to previously described sub-section 14*a* in all respects except one. Specifically, whereas the previously described sub-section 14*a* included a network of channels including the channels 40, 42 and 44, the channeled network of sub-section 14*a*′ includes a continuous channeled surface extending into surface 36*a* uniformly along its entire extent. This channeled surface which is generally indicated at 50 extends from the back end of section 14*a* to its front end a predetermined distance from the sides of the sub-section, as best illustrated in FIG. 9. In this way, when sub-section 14*a*′ is engaged with previously described sub-section 14*b* (in the same manner as sub-sections 14*a* and 14*b*), a network of grooves is formed to allow passage of the adhesive substance from adhesive receiving section 12 to the various applicating surfaces of the dispensing head.

What is claimed is:

1. A dispensing head for applying adhesive to a contoured surface of one object which is to be bonded to a complementary surface of another object, said dispensing head comprising:

(a) a first body member adapted for connection to a supply of adhesive and including an internal plenum chamber for receiving adhesive from said supply;

(b) a second body member having front and back ends and being disengagably connected with said first member, said second body member including (i) an adhesive applying surface substantially complementary to the contoured surface of said one object, said adhesive applying surface being located on said front end and including a first group of spaced-apart planar surfaces which substantially lie in a common plane and a second group of spaced-apart planar surfaces which project out from said first group of surfaces, said second planar surfaces intersecting said first planar surfaces so as to define substantially parallel lines of intersection, (ii) two separate sections having complementary confronting surfaces extending from the front end of said second body member to its back end normal to said first group of planar surfaces, (iii) a network of opened channels located in one of said sections inwardly from the confronting surface of that section and extending between said adhesive receiving plenum chamber and said planar surfaces for dispensing adhesive to said planar surfaces, said network including a first group of opened channels extending inward between said second group of planar surfaces in a direction substantially parallel with said first group of planar surfaces, a second group of channels substantially narrower than said first group of channels and extending between said first group of channels and said plenum chamber, and a third group of channels substantially narrower than said first group and extending between said first group of planar surfaces and said plenum chamber, and (iv) means for disengagably connecting said sections together so that said confronting surfaces engage one another and so that each of said channels is closed along its length.

2. A dispensing head according to claim 1 wherein said second and third group of channels are substantially parallel to one another, said second group of channels extending deeper into said one section from the confronting surface of the latter than said first group of channels and extending into portions of said first group of channels.

3. A dispensing head for applying adhesive to a contoured surface of one object which surface is to be bonded to a complementary surface of another object, said dispensing head comprising:

(a) a first section adapted for connection to a supply of adhesive and including means for receiving adhesive from said supply; and (b) a second section which is connected with said first section and which includes two subsections having confronting surfaces extending from a back end of said second section to a front end thereof, said second section also including (i) an adhesive applying surface in the form of spaced apart projecting fingers which are substantially complementary to the contoured surface of said one object and which together define a plurality of intersecting planar surfaces forming the front end of said second section, (ii) a single continuous channel extending a uniform distance into one of said confronting surfaces from said back end at and in fluid communication with said adhesive receiving means of said first section to said front end including said fingers for dispensing adhesive therefrom, and (iii) means for disengagably holding said subsections together so that said confronting surfaces engage one another, whereby to provide ready access into and along the length of said channel.

* * * * *